US006628064B1

(12) United States Patent
Miura

(10) Patent No.: US 6,628,064 B1
(45) Date of Patent: Sep. 30, 2003

(54) CATHODE-RAY TUBE

(75) Inventor: Yasunori Miura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/507,137

(22) Filed: Feb. 18, 2000

(30) Foreign Application Priority Data

Feb. 24, 1999 (JP) ..... 11-046214

(51) Int. Cl.[7] ..... H01J 29/88
(52) U.S. Cl. ..... 313/479; 313/313
(58) Field of Search ..... 313/479, 313; 445/35, 37; 439/95, 96

(56) References Cited

U.S. PATENT DOCUMENTS

| | | | | |
|---|---|---|---|---|
| 4,916,358 A | * | 4/1990 | Bunton | |
| 5,025,490 A | | 6/1991 | Tamura | 313/479 |
| 5,879,217 A | | 3/1999 | Saito et al. | 445/23 |
| 6,139,389 A | * | 10/2000 | Dreyer et al. | |

FOREIGN PATENT DOCUMENTS

| | | |
|---|---|---|
| EP | 0 589 147 | 3/1994 |
| JP | 5-343007 | 12/1993 |
| JP | 8-287850 | 11/1996 |
| JP | 9-120784 | 5/1997 |
| JP | 10-003868 | 1/1998 |
| JP | 10-233180 | 9/1998 |
| JP | 11-17385 | 1/1999 |

* cited by examiner

*Primary Examiner*—Sandra O'Shea
*Assistant Examiner*—Guiyoung Lee
(74) *Attorney, Agent, or Firm*—Merchant & Gould, P.C.

(57) ABSTRACT

A surface treatment film composed of a conductive film with a surface resistance of $1\times10^3\Omega/\square$ or more and an antireflection film is provided on the surface of a glass panel. A ground electrode is provided on the surface treatment film so as to be electrically connected with the conductive film. The ground electrode is grounded in a circuit manner. An area of the surface treatment film covered with the ground electrode is set at 500 $mm^2$ or more. Thus, even in the case where the conductive film has a resistance of $1\times10^3\Omega/\square$ or more, an effect of suppressing a leakage electric field to 1.0 V/m or less, which satisfies the TCO guideline, can be realized.

3 Claims, 7 Drawing Sheets

CATHODE-RAY TUBE

BACKGROUND OF THE INVENTION

1. Field of the Invention

The present invention relates to a cathode-ray tube. In particular, the present invention relates to a structure of a ground electrode for reducing an undesired electromagnetic field generated particularly on a front surface of glass panel.

2. Description of the Related Art

FIG. 6 is a partially cut-away perspective view of a general cathode-ray tube (hereinafter, referred to as a "CRT") apparatus composed of a CRT and a deflection yoke. The CRT includes a glass panel 1, a glass covering composed of a funnel part 91 and a neck part 92, an electron gun 93 sealed in the neck part 92, a fluorescent screen surface 96 formed on an inner surface of the glass panel 1, color selection electrodes 97 disposed on the electron gun 93 side of the fluorescent screen surface 96 so as to maintain a predetermined interval, a magnetic shield 98, and a multi-layer film (not shown) having antistatic and antireflection functions, formed on an outer surface of the glass panel 1. The deflection yoke 95 is attached to the periphery of the neck part 92 of the CRT so as to deflect an electron beam 94 radiated from the electron gun 93.

FIG. 7 is a plan view of the glass panel 1, and FIG. 3 is an enlarged cross-sectional view of a peripheral portion of the glass panel 1. A surface treatment film 8 composed of a conductive film 3 and a multi-layer film 2 of insulating layers 4 having an antireflection function and the like is formed on the surface of the glass panel 1. A ground electrode 6 is provided on the surface treatment film 8 so as to be electrically connected with the conductive film 3 through ultrasonic solder (Japanese Laid-Open Publication No. 8-287850). As shown in FIG. 7, in general, a pair of ground electrodes 6 are provided on upper and lower portions of the glass panel 1 outside an effective screen region 9.

The fluorescent screen surface 96 is held at a potential of an anode supplied with a high voltage. Therefore, the glass panel 1 is charged to a high potential, which may have adverse effects such as giving shock to a user and causing electronic equipment in the vicinity to malfunction due to discharge. The conductive film 3 and the ground electrode 6 are provided for the purpose of avoiding such a situation.

In recent years, concerns are rising that an electromagnetic wave generated from the deflection yoke 95 which operates repeatedly at a high frequency and an anode part of the electron gun 93 may have some effect on the bodies of a user and people in the vicinity. In Sweden, as guidelines for a display apparatus for a terminal, MPR (The Swedish National Board for Measurement and Testing) and TCO (The Swedish Confederation of Professional Employees) are issued. These guidelines stipulate the suppression of a leakage electric field generated by a display apparatus. According to the most strict TCO guideline, it is required to define a leakage electric field to be 1.0 V/m or less with respect to an alternating electric field in a VLF (Very Low Frequency) band (i.e., 2 kHz to 400 kHz) at a position 30 cm away from the front surface of a glass panel.

As a technique for satisfying the stipulation of the TCO guideline, for example, Japanese Laid-Open Publication No. 10-3868 discloses that a transparent conductive film with a high refractive index having a surface resistance of $9\times10^2\Omega/\square$ or less is formed on the outer surface of a glass panel, and a plurality of terminals electrically connected with the conductive film are disposed on two or four sides of the glass panel. Furthermore, Japanese Laid-Open Publication No. 10-233180 discloses that a conductive film with a surface resistance of $1\times10^3\Omega/\square$ or less and an antireflection film (hereinafter, referred to as an "AR film") are formed on a transparent substrate, the resultant substrate is attached to the outer surface of a glass panel, and an electrode is provided on the outermost layer so as to be grounded in an electrical circuit manner.

In both of the above-mentioned prior art, an electric potential induced on the glass panel is allowed to dissipate to a ground surface on the circuit through the electrode on the outermost surface of the glass panel, whereby it is attempted to prevent the surface of the glass panel from reaching a high potential.

In order to suppress sufficiently a leakage electric field generated on the surface of a glass panel from a deflection yoke and an anode line by using the above-mentioned prior art, the resistance of the conductive film formed as a lower layer of the AR film on the glass panel is required to be about $1\times10^3\Omega/\square$ or less. However, in order to form a conductive film with a low resistance, a special material containing silver and platinum must be coated by spin coating or sputtering. This increases the production cost. If it is attempted to satisfy the stipulation of the TCO guideline, using a conductive film having a resistance of $1\times10^3\Omega/\square$ or more, it is required to separately provide a cancel circuit for canceling a leakage electric field, which increases the cost and the number of steps on a circuit side.

SUMMARY OF THE INVENTION

Therefore, with the foregoing in mind, it is an object of the present invention to provide a structure of a glass panel that has an effect of sufficiently suppressing a leakage electric field even using a conductive film having a resistance of $1\times10^3\Omega/\square$ or more.

A cathode-ray tube of the present invention has a structure in which a surface treatment film including an antireflection film layered on a conductive film with a surface resistance of $1\times10^3\Omega/\square$ or more is provided on a surface of a glass panel, and a ground electrode electrically connected with the conductive film and grounded is formed on the surface treatment film, wherein a surface area of the ground electrode is 500 $mm^2$ or more. By setting the surface area of the ground electrode (i.e., a contact area between the ground electrode and the conductive film) at a predetermined value or more, a leakage electric field can be suppressed to 1.0 V/m or less with respect to an alternating electric field in a VLF band.

Furthermore, it is preferable that the ground electrode is provided in a band shape so as to be substantially parallel to an outer edge of the glass panel outside an effective screen of the glass panel, and the ground electrode has a length of 100 mm or more and a width of 5 mm or more. Because of this, a space of the glass panel outside the effective screen can be efficiently used.

Furthermore, it is preferable that the ground electrode is provided on a side where at least an anode terminal is provided among outer edges of the glass panel. The anode terminal is supplied with the highest voltage and is one of the main sources for causing a leakage electric field. Therefore, by providing the ground electrode in the vicinity of the anode terminal, a leakage electric field can be efficiently suppressed.

Furthermore, it is preferable that the ground electrode is formed by ultrasonic solder. If ultrasonic solder is used, the ground electrode can be formed directly on the surface treatment film without peeling off the surface treatment film.

These and other advantages of the present invention will become apparent to those skilled in the art upon reading and understanding the following detailed description with reference to the accompanying figures.

DESCRIPTION OF THE PREFERRED EMBODIMENTS

The CRT of the present invention is characterized by the size, attachment position, and number of ground electrodes provided on a glass panel. Hereinafter, these features of the present invention will be described, and the description of the other parts will be omitted.

Figure 1:
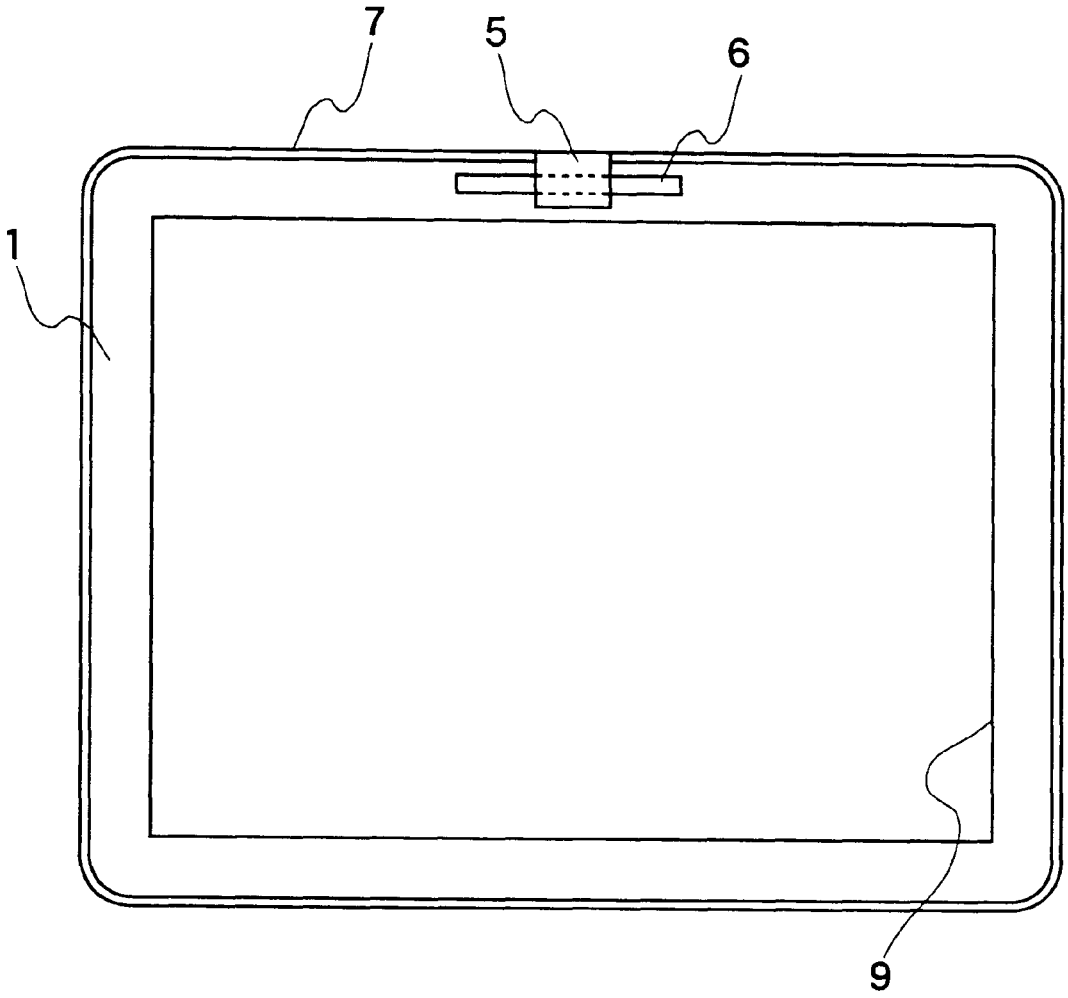
FIG. 1 is a plan view of a glass panel of a CRT according to the present invention.

FIG. 1 is a plan view of a glass panel according to the present invention. In the CRT of the present invention, a surface treatment film (not shown) composed of an AR film and a conductive film with a surface resistance of $1\times10^3\Omega/\square$ or more is provided on the surface of a glass panel 1. A ground electrode 6 is formed on the surface treatment film, using ultrasonic solder or the like, as a conductive film so as to be electrically connected with the conductive film. The ground electrode 6 is electrically connected with a reinforcing band 7 through a conductive tape 5.

Figure 3:
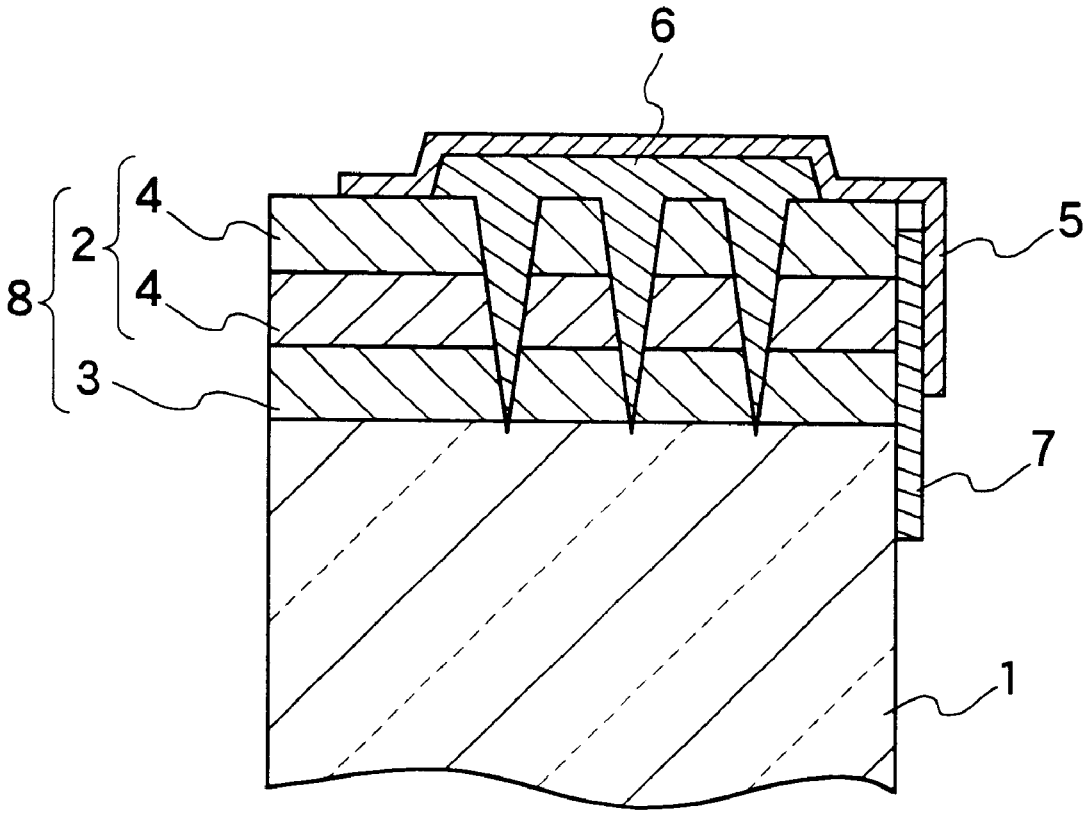
FIG. 3 is a side cross-sectional view of a peripheral portion of a glass panel according to the present invention and a conventional glass panel.

The cross-section of a peripheral portion of the glass panel 1 has the same structure as that of the prior art as shown in FIG. 3. The surface treatment film 8 is composed of a conductive film 3 (lowermost layer) and a double-layer insulating film (AR film) 4 made of insulator layered on the conductive film 3. The surface treatment film 8 may be formed by direct coating onto the glass panel 1 or by attachment of an AR panel to the glass panel 1. The conductive film 3 mainly contains ruthenium oxide ($Ru_2O$) with a surface resistance of $5\times10^3\Omega/\square$, and has a thickness of about 0.1 $\mu$m. The conductive film 3 may be made of a material mainly containing tin oxide ($SnO_2$), a material mainly containing ITO, or a material mainly containing a mixture of silver (Ag) and palladium (Pd). The insulating film 4 includes the first layer of $RuO_2$ (thickness: 180 nm; refractive index: 1.75) and the second layer of $SiO_2$ (thickness: 150 nm; refractive index: 1.47).

Figure 2:
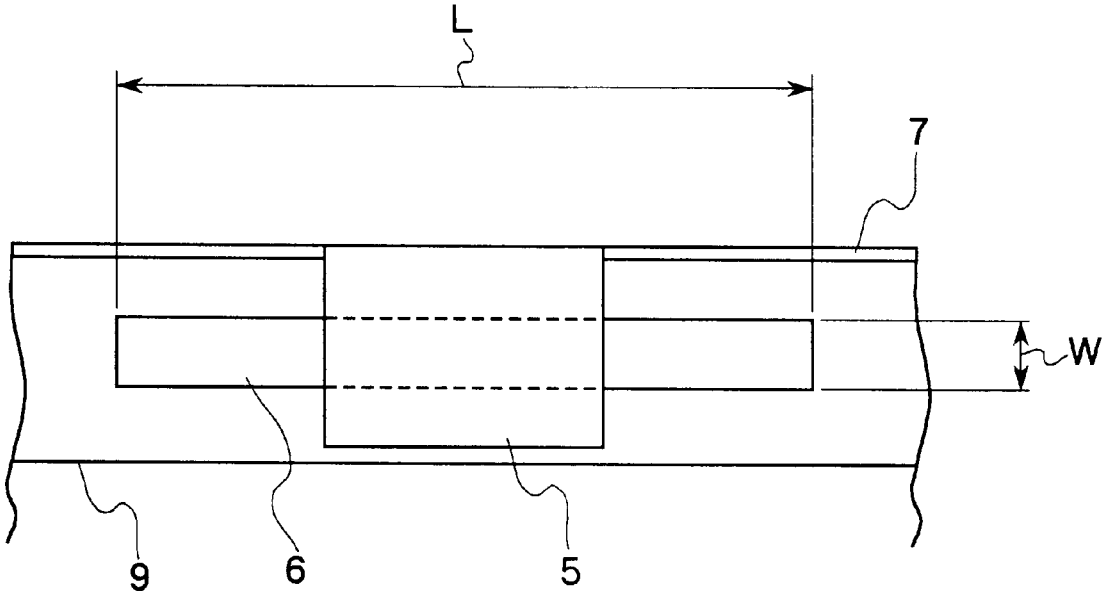
FIG. 2 is an enlarged plan view of a ground electrode.

The ground electrode 6 has a width W of 5 mm and a length L of 100 mm, as shown in FIG. 2. The ground electrode 6 is provided at one middle position on the side of an anode terminal (not shown) outside an effective screen region 9 of the glass panel 1, so as to have a band shape substantially in parallel with an outer edge of the glass panel 1, by using ultrasonic solder, conductive frit glass, or the like. The width W of the ground electrode 6 is limited by the size of the effective screen region 9 occupying the glass panel 1. When the width W is too small, the length L must be increased. Therefore, the width W is preferably set at 5 mm or more. The ground electrode 6 may be formed by peeling off a predetermined area of the insulating film 4, followed by coating the area with a conductive material.

In the case of forming the ground electrode 6 using ultrasonic solder, a soldering iron should be brought into contact with a predetermined position of the surface treatment film 8, and moved substantially in parallel with the outer edge of the glass panel 1. If the width W of the ground electrode 6 is set at 5 mm, one ground electrode 6 can be formed by one step, using an ordinary soldering iron, which shortens a production time. When the ground electrode 6 is formed, solder simultaneously permeates through the insulating film 4 to reach the conductive layer 3. FIG. 3 schematically shows a state where the ground electrode 6 is electrically connected with the conductive film 3. Actually, they are continuously connected. As an ultrasonic soldering apparatus, "Sunbonder"(produced by Asahi Glass Co., Ltd. ) was used, and as a solder, "Cerasolzer"(produced by Asahi Glass Co., Ltd. ) was used. An ultrasonic frequency was set at 60 kHz, and a solder temperature was set in a range of 120° C. to 280° C.

The present invention was applied to a color CRT for a 46-cm (19-inch) computer monitor, and a leakage electric field was measured in accordance with the TCO guideline. A leakage electric field generated on the front surface of the glass panel 1 was 0.98 V/m in a VLF band, which satisfied the TCO guideline. For comparison with the prior art, a leakage electric field was measured in the case where a ground electrode with a size of 5 mm×10 mm was attached to two sides of the surface treatment film (i.e., on the anode terminal side and the opposite side thereof). The leakage electric field was 1.50 V/m in a VLF band.

Next, the relationship among the size, attachment position, and number of ground electrodes, and an effect of suppressing a leakage electric field will be described. In either case, a conductive film mainly contains $Ru_2O$ with a resistance of $5\times10^3\Omega/\square$ and has a thickness of about 0.1 $\mu$m.

Figure 4:
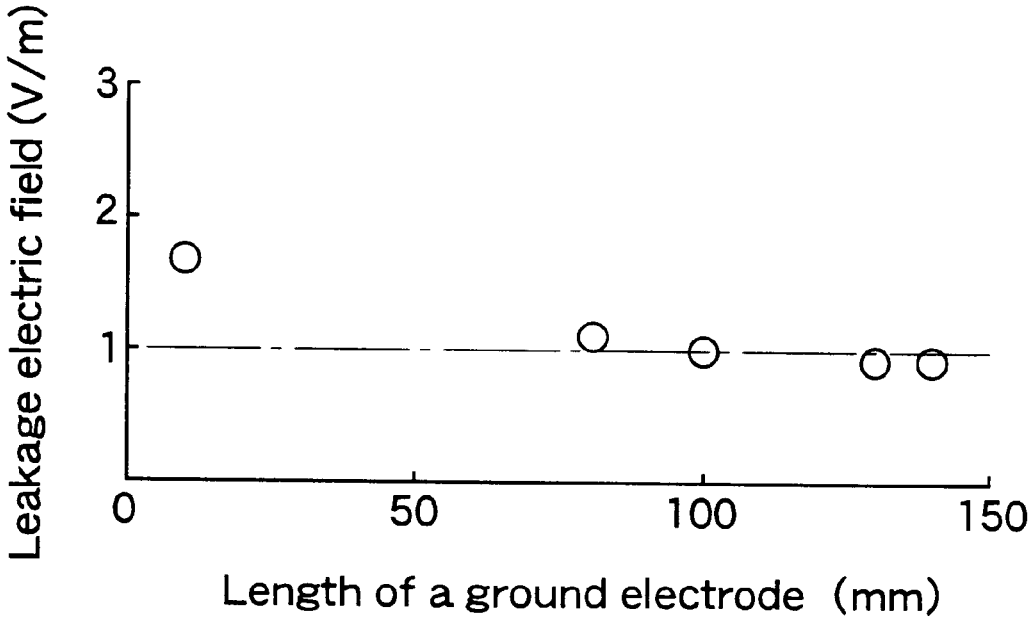
FIG. 4 shows a relationship between the size of a ground electrode and a leakage electric field.

FIG. 4 shows a relationship between the size of the ground electrode 6 and a leakage electric field in the case where the ground electrode 6 is attached to only one middle portion on the anode terminal side. The width of the ground electrode 6 was set constant (5 mm). It is understood from FIG. 4 that when the length of the ground electrode 6 is larger than 100 mm, a leakage electric field becomes less than 1 V/m.

Table 1 shows a relationship between the attachment position of the ground electrode and a leakage electric field. In Table 1, N represents a north (upper) side (i.e., anode terminal side) of the glass panel, S represents an opposite side of N, W represents a left side, and E represents a right side, respectively, toward the glass panel. The ground electrode 6 has a size of 5 mm×100 mm, and is disposed on each side of the glass panel substantially in parallel with each outer edge thereof outside an effective screen of the glass panel.

TABLE 1

| Position of a ground electrode | Leakage electric field [V/m] |
|---|---|
| N side | 0.98 |
| S side | 1.04 |

TABLE 1-continued

| Position of a ground electrode | Leakage electric field [V/m] |
|---|---|
| W side | 1.10 |
| E side | 1.12 |

As is understood from Table 1, in the case where the ground electrode is disposed on the N side, the largest effect of suppressing a leakage electric field is obtained. The reason for this is believed to be as follows. Since the strongest leakage electric field is obtained in the vicinity of an anode terminal, to which the highest voltage used for a CRT is supplied, a leakage electric field is most effectively suppressed by providing a ground electrode in the vicinity of the anode terminal.

Table 2 shows a comparison of an effect of suppressing a leakage electric field between the conventional ground electrode and the ground electrode according to the present invention in the case where a plurality of ground electrodes are attached. The size of each conventional ground electrode is 5 mm×10 mm, and the size of each ground electrode according to the present invention is 5 mm×10 mm.

TABLE 2

| Position and number of ground electrodes | Leakage electric field [V/m] |
|---|---|
| (1) | 1.50 |
| (2) | 1.20 |
| (3) | 1.04 |
| (4) | 0.86 |
| (5) | 0.72 |
| (6) | 0.52 |
| (7) | 0.82 |

In Table 2, (1) to (3) represent prior art, and (4) to (7) represent the present invention. In the case of (1), the number of ground electrodes is one for the N and S sides, respectively. In the case of (2), the number of ground electrodes is one for the N, S, E, and W sides, respectively. In the case of (3), the number of ground electrodes is two for the N and S, respectively, and one for the E and W sides, respectively. In the case of (4), the number of ground electrodes is one for the E and W sides, respectively. In the case of (5), the number of ground electrodes is one for the N and S sides, respectively. In the case of (6), the number of electrodes is one for the N, S, E, and W sides, respectively. In the case of (7), the number of electrodes is one for the N, S, E, and W sides, respectively. Only in the case of (7), the resistance of the conductive film was set at $3\times10^4\Omega/\square$. In the prior art, a leakage electric field does not become 1 V/m or less, whereas according to the present invention, a leakage electric field becomes 1 V/m or less. Furthermore, when two ground electrodes are provided, it is understood that an effect of suppressing a leakage electric field is increased more in the case where ground electrodes are attached to the N and S sides than in the case where ground electrodes are attached to the E and W sides. In the case where one ground electrode is attached to each of the N, S, E, and W sides, even if the resistance of the conductive film is high ($3\times10^4\Omega/\square$), a leakage electric field can be suppressed to 1 V/m or less.

Figure 5:
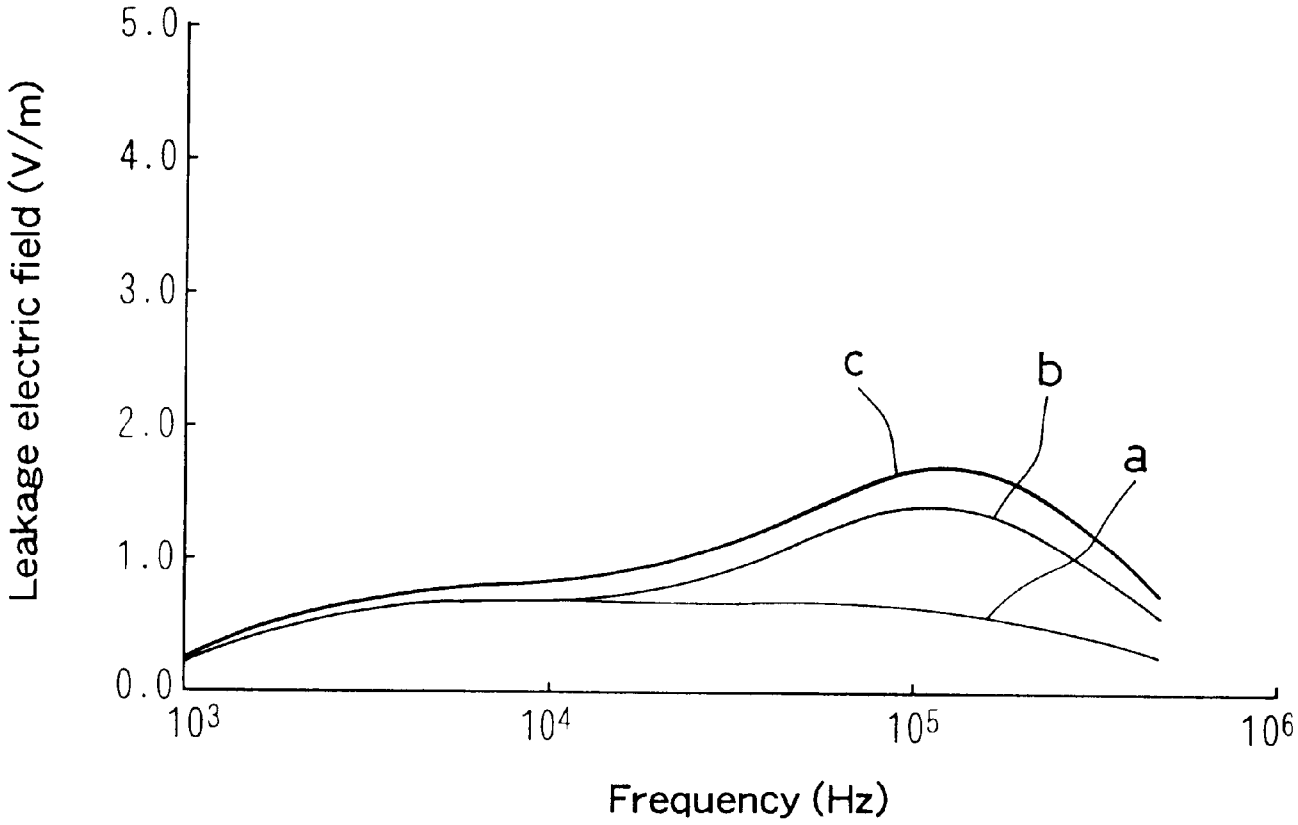
FIG. 5 shows a comparison of frequency characteristics of a leakage electric field between the present invention and the prior art.
Figure 6:
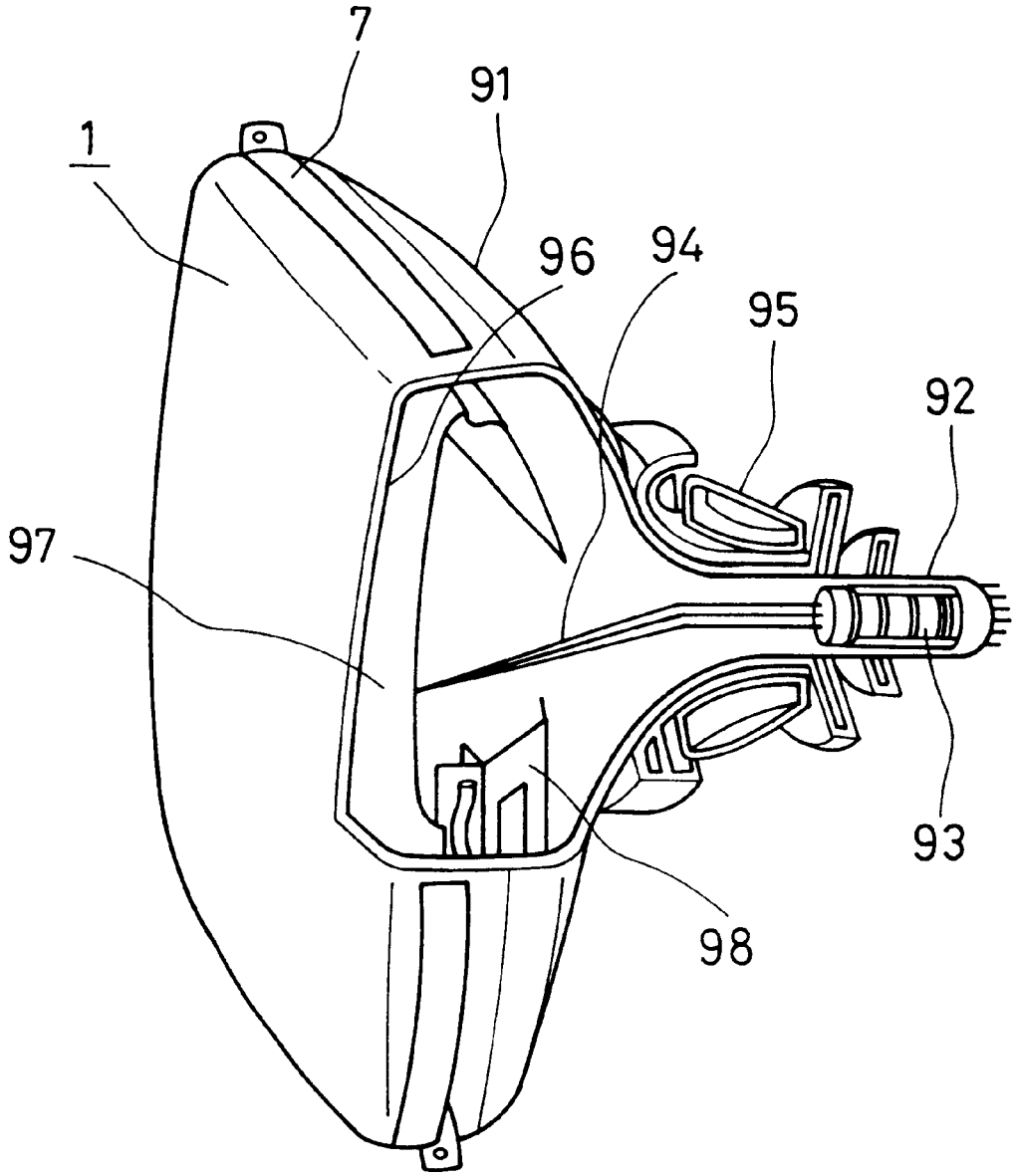
FIG. 6 is a partially cut-away perspective view of a general CRT.
Figure 7:
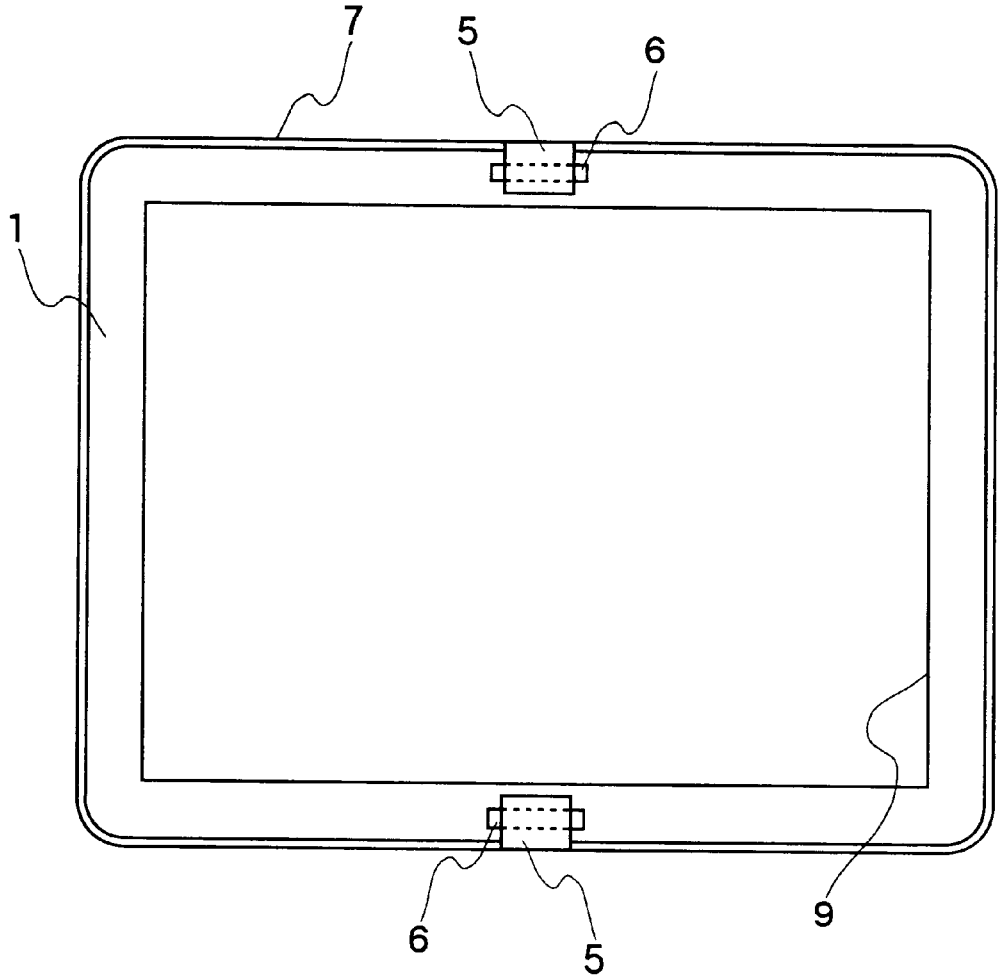
FIG. 7 PRIOR ART
FIG. 7 is a plan view of a conventional glass panel.

FIG. 5 shows a comparison of frequency characteristics of a leakage electric field between the present invention and the prior art. Under the condition that a deflection yoke is attached to a CRT, an alternating current (rectangular wave) with a peak-to-peak value of 5 volts having predetermined frequency characteristics is allowed to flow only through the anode portion, whereby an effect of suppressing a leakage electric field only by a surface treatment film is examined. In FIG. 5, a curve a represents the case where one ground electrode (5 mm×100 mm) is provided on the N and S sides, respectively (present invention). A curve b represents the case where one ground electrode (5 mm×10 mm) is provided on the N and S sides, respectively (prior art). A curve c represents the case where no ground electrodes are provided. It is understood from FIG. 5 that according to the present invention, a leakage electric field can be reduced over a frequency band of $10^3$ to $10^6$ Hz.

As described above, according to the present invention, a satisfactory effect of suppressing a leakage electric field is obtained by enlarging an electrode area, and appropriately setting the position and number of electrodes. As a result, a leakage electric field can be suppressed to 1.0 V/m or less, which satisfies the TCO guideline, by an inexpensive method, even when using a conductive layer with a resistance of $1\times10^3\Omega/\square$ or more.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode-ray tube, comprising:

a glass panel having an outer edge and an effective screen area;

a reinforcing band supporting the outer edge of the glass panel;

a surface treatment film formed on the glass panel, the surface treatment film including an antireflection film layered on a conductive film having a surface resistance of $1\times10^3\Omega$/or more;

a ground electrode formed on the surface treatment film, the ground electrode being electrically connected with the conductive film and having a surface area of 500 $mm^2$ or more, the ground electrode having a band shape and positioned so as to be substantially parallel to the outer edge of the glass panel on a side of the panel where at least an anode terminal is provided, outside the effective screen area of the glass panel; and a conductive tape attached to the ground electrode, the conductive tape being a different member from the ground electrode and electrically connecting the ground electrode to the reinforcing band.

2. A cathode-ray tube according to claim 1, wherein the ground electrode has a length of 100 mm or more and equal to or less than a length of the outer edge of the glass panel, and a width of 5 mm or more and equal to or less than a width of the region outside the effective screen of the glass panel.

3. A cathode-ray tube according to claim 1, wherein the ground electrode is formed by ultrasonic solder.

* * * * *